US005682700A

United States Patent [19]

Sandberg

[11] Patent Number: 5,682,700

[45] Date of Patent: Nov. 4, 1997

[54] RIFLE CLEANING GRADLE

[76] Inventor: Steven Robert Sandberg, 11802 Akron Ave., Inver Grove Heights, Minn. 55077

[21] Appl. No.: 788,700

[22] Filed: Jan. 24, 1997

[51] Int. Cl.[6] ..... F41A 23/18

[52] U.S. Cl. ..... 42/94; 211/64; 248/176.1

[58] Field of Search ..... 42/94; 89/37.04; 211/64; 269/900, 902; 248/176.1

[56] References Cited

U.S. PATENT DOCUMENTS

| | | | |
|---|---|---|---|
| 2,589,039 | 3/1952 | Booth | 211/64 |
| 2,847,909 | 8/1958 | Kester | 42/94 |
| 3,772,813 | 11/1973 | Sands | 42/94 |
| 4,967,497 | 11/1990 | Yakscoe | 42/94 |
| 5,284,280 | 2/1994 | Stonebraker, Sr. et al. | 42/94 |
| 5,287,643 | 2/1994 | Arizpe-Gilmore | 42/94 |

FOREIGN PATENT DOCUMENTS

| | | | |
|---|---|---|---|
| 96485 | 8/1897 | Germany | 89/37.04 |
| 96183 | 4/1960 | Norway | 211/64 |

*Primary Examiner*—Stephen M. Johnson
*Attorney, Agent, or Firm*—Thomas B. Tate

[57] ABSTRACT

A rifle cleaning cradle for a folding rifle. The cradle is formed by a continuous rod which has base pieces which rest on a flat surface, a braced U-shaped piece at one end and an arch-shaped piece at the opposite end, and means for attaching a bungee cord which wraps around the cradle to hold a rifle in the open position for cleaning.

2 Claims, 2 Drawing Sheets

RIFLE CLEANING GRADLE

SUMMARY AND BACKGROUND OF THE INVENTION

Rifles which fold in half, such as the M-16 used by the U.S. Army or the AR-15, a similar civilian rifle used for target shooting, pose special problems for the person cleaning the weapon. In order to clean the barrel, the rifle must be partially disassembled by removing the rear push pin so that the lower receiver folds down from the barrel, and the bolt is removed. A long cleaning rod having a brush or a cloth patch on one end is then inserted into the bore of the barrel from the breech end and is run repeatedly down the barrel until the barrel is clean. The barrel is usually laid on a flat surface or held in the palm of the hand during this process. This procedure is cumbersome, since the cleaning rod can get stuck part-way down the barrel if it is not inserted perfectly straight, and vigorous thrusting of the rod down the barrel tends to cause the lower receiver to snap shut and pinch the fingers of the person cleaning the weapon. Some people try to avoid these problems by totally separating the lower receiver from the barrel before cleaning, but this involves additional tedious disassembly and re-assembly.

Two main types of rests for rifle cleaning are known in the prior art. The most common type is a cradle which has two grooves which hold a standard rifle for cleaning in a horizontal position. An example of this type is U.S. Pat. No. 4,873,777. The other type is a stand for cleaning muzzle loading rifles in a vertical position. U.S. Pat. No. 4,696,461 is an example of this type. Neither of these types is suitable for cleaning folding rifles.

The primary object of the present invention is to provide a cradle for holding a folding rifle firmly in the open position for cleaning. The barrel of the rifle rests horizontally in a U-shaped niche at the proximal end, and at the distal end extends between the sides of an arch which prevents the rifle from turning sideways. The lower receiver hangs down vertically and is held open by a bungee cord which is wrapped around it and is attached to the opposite (arch-shaped) end of the cradle.

Another object of the invention is to make it easier to remove and install the rear push pin on a rifle which lacks a scope sight. This is accomplished by putting the rifle in the cradle, rotating the rifle 180 degrees until it is upside-down, pushing down on the rear of the stock in order to relieve pressure on the push pin and cause it to disengage more easily, then rotating the rifle 180 degrees so it is right side up. The stock and lower receiver then swings down, and the bungee cord can be installed to hold the rifle open for cleaning.

DESCRIPTION OF THE INVENTION

Figure 1:
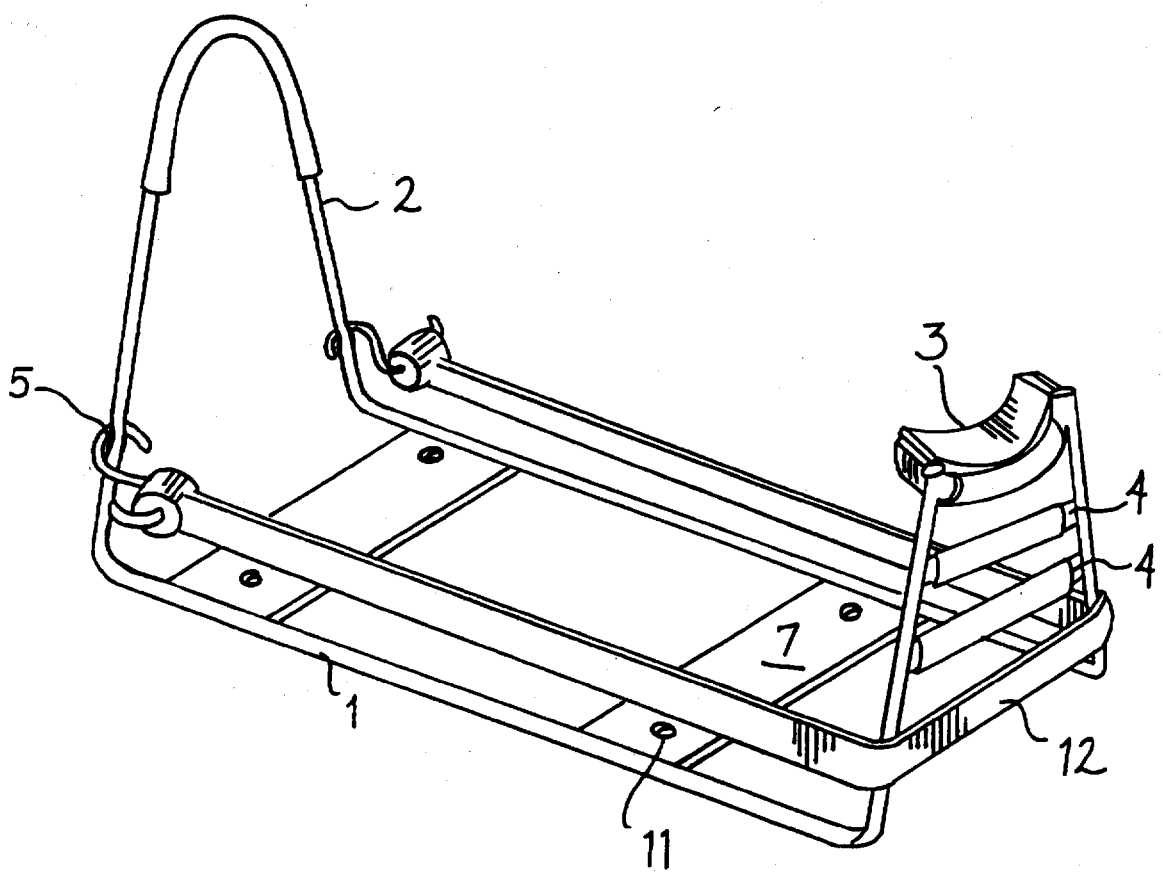
FIG. 1 is a perspective view.
Figure 2:
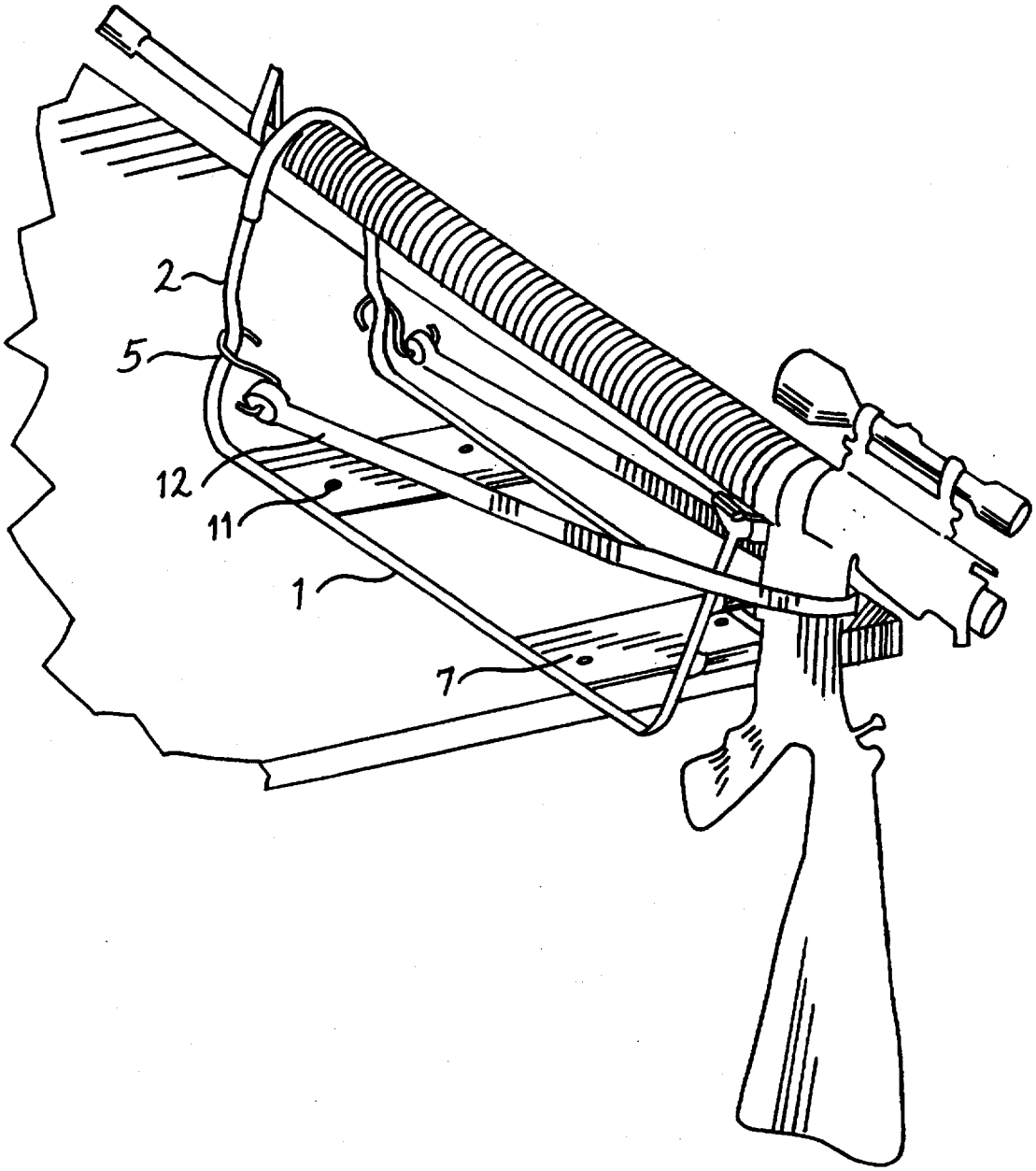
FIG. 2 is a perspective view showing the invention mounted on a table, with a rifle inserted and opened for cleaning.

The invention is a rifle cleaning cradle which is formed from a continuous round rod. The two base pieces 1 are long straight parallel sections which rest upon a flat surface such as a table or a workbench. The base pieces 1 curve upward at either end to form an arch-shaped piece 2 at one end and a U-shaped piece 3 at the opposite end. The U-shaped piece 3 has bracing 4 beneath it for support. The arch-shaped piece 2 has a pair of crimped recesses 5 formed into it for attachment of a bungee cord 12. The U-shaped piece 3 and its bracing 4 and the top of the arch-shaped piece 2 have a dipped rubber coating to prevent marring of the finish of the rifle. Straps 7, preferably made of steel, are attached between the base pieces 1, preferably by welding. Each of the straps 7 has mounting holes 11 formed into it, through which screws or clamps can be disposed to fasten the cradle to the table or workbench. The cradle should be lined up so that the strap 7 which is closest to the U-shaped end 3 is even with the edge of the table, and the U-shaped end 3 therefore extends beyond the edge of the table.

For cleaning, the rifle is placed into the cradle so that the proximal end of the barrel rests horizontally on the U-shaped piece 3 and the distal end of the barrel extends between the sides of the arch-shaped piece 2, with the rifle's front sight resting against the outer edge of the arch-shaped piece 2, thus preventing the rifle from turning while it is being cleaned. The rifle's push pin is then removed to allow the lower receiver to open and hang down in a vertical position beyond the edge of the table. A bungee cord 12 is then attached to the crimped recesses 5 of the arch-shaped end 2 and is extended to fit around the cradle and the rifle's lower receiver to hold the rifle in the open position for cleaning.

Pegs may be used as an alternative to the crimped recesses 5 for mounting the bungee cord 12. Another modification may be used for rifles which have longer and heavier barrels and lack a front sight. This version would additionally have a support formed by extending a horizontal piece forward from the strap 7 which is nearest the arch-shaped piece 2, then extending a vertical piece upward from said horizontal piece, then having a U-shaped support on top of said vertical piece, said U-shaped support being positioned between the sides of the arch-shaped piece 2.

I claim:

1. A rifle cleaning cradle for cleaning folding rifles, said cradle comprising:

a continuous rod formed to comprise two base pieces which are long straight sections adapted to rest upon a flat surface, said base pieces curving upward at either end, to form an arch-shaped piece at one of said ends, said arch-shaped piece receiving the barrel of said rifle within, said arch-shaped piece having means for attaching a bungee cord thereto, and to form a U-shaped braced piece at the end opposite said arch-shaped piece, said U-shaped piece having said barrel of said rifle resting thereon such that said barrel is horizontal and the lower receiver of said rifle hangs down vertically when said rifle is opened;

straps connecting said base pieces, said straps having mounting holes defined therein through which mounting devices can be disposed to maintain said cradle in position on said flat surface;

and said bungee cord which is attached to said means for attaching said cord on said arch-shaped piece and which extends around said lower receiver of said rifle to hold said rifle open while it is being cleaned.

2. The invention of claim 1 wherein said means for attaching said bungee cord comprises crimped recesses formed into said arch-shaped piece.

* * * * *

UNITED STATES PATENT AND TRADEMARK OFFICE

CERTIFICATE OF CORRECTION

PATENT NO. : 5,682,700
DATED : November 4, 1997
INVENTOR(S) : Steven Robert Sandberg It is certified that error appears in the above-identified patent and that said Letters Patent is hereby corrected as shown below:

On title page, item [54], and col.. 1, line 1, title should read:
--RIFLE CLEANING CRADLE--

Signed and Sealed this

Thirteenth Day of January, 1998

*Attest:*

*Attesting Officer*

BRUCE LEHMAN

*Commissioner of Patents and Trademarks*